US007927180B2

(12) United States Patent
Simpson

(10) Patent No.: US 7,927,180 B2
(45) Date of Patent: Apr. 19, 2011

(54) BRASSIERE WITH EDGE BONDING OF SIDE PANEL LAYERS

(75) Inventor: Elisabeth Simpson, Hong Kong (CN)

(73) Assignee: Triumph Intertrade AG, Bad Zurzach (CH)

( * ) Notice: Subject to any disclaimer, the term of this patent is extended or adjusted under 35 U.S.C. 154(b) by 420 days.

(21) Appl. No.: 12/116,202

(22) Filed: May 7, 2008

(65) Prior Publication Data

US 2008/0280535 A1 Nov. 13, 2008

(30) Foreign Application Priority Data

May 7, 2007 (DE) ..... 20 2007 006 694 U

(51) Int. Cl.
*A41C 3/00* (2006.01)

(52) U.S. Cl. ..... 450/92; 450/93; 450/1

(58) Field of Classification Search ..... 450/20, 450/21, 74–76, 39, 40, 60, 92, 93, 1, 3, 4, 450/7, 8; 2/243.1

See application file for complete search history.

(56) References Cited

U.S. PATENT DOCUMENTS

| | | | | |
|---|---|---|---|---|
| 5,660,577 | A * | 8/1997 | Modena | 450/86 |
| 5,916,829 | A * | 6/1999 | Girard et al. | 442/244 |
| 6,000,994 | A * | 12/1999 | Salotto | 450/92 |
| 6,180,178 | B1 * | 1/2001 | Vogt | 427/389.9 |
| 6,238,266 | B1 * | 5/2001 | Vogt | 450/19 |
| 6,287,168 | B1 * | 9/2001 | Rabinowicz | 450/75 |
| 6,837,771 | B2 * | 1/2005 | Falla | 450/39 |
| 7,192,332 | B2 * | 3/2007 | Liu | 450/39 |
| 7,407,427 | B2 * | 8/2008 | Liu | 450/39 |
| 7,563,152 | B2 * | 7/2009 | Liu | 450/39 |
| 7,682,219 | B2 * | 3/2010 | Falla | 450/92 |
| 2010/0144242 | A1 * | 6/2010 | Allen et al. | 450/39 |

* cited by examiner

*Primary Examiner* — Gloria Hale
(74) *Attorney, Agent, or Firm* — Muncy, Geissler, Olds & Lowe, PLLC

(57) ABSTRACT

A brassiere is provided having a front piece incorporating two breast cups and with two side pieces extending around the upper body of an individual wearing the brassiere, the first ends of which are fastened to the front piece at the sides and the second ends of which can be connected together in the back area of the individual. According to the invention, each of the side pieces includes two layers of a textile material, namely an outer layer and an inner layer. The layers are fastened together at the free edges in such a way that the layer of the textile material forming the outside is folded over toward the inside to form marginal edges and that these edge areas are connected by an adhesive layer with the opposite side of the textile material forming the inside.

7 Claims, 2 Drawing Sheets

BRASSIERE WITH EDGE BONDING OF SIDE PANEL LAYERS

This nonprovisional application claims priority under 35 U.S.C. §119(a) to German Patent Application No. 20 2007 006 694.5, which was filed in Germany on May 7, 2007, and which is herein incorporated by reference.

BACKGROUND OF THE INVENTION

1. Field of the Invention

The invention relates to a brassiere.

2. Description of the Background Art

Brassieres of this class are commonly known, and are available in a multitude of variations all over the world. They are constructed of a front section, which essentially comprises two bra cups, which come in a wide variety of different shapes, and which are interconnected by a center part. Connected to the respective outer lateral edges of the front section is a side panel, the free ends of which can be joined at the back of the person wearing the brassiere by a back closure. The side panels can be sewn to the front section, but they can also form a one-piece unit with the front section. Because the essential function of such brassieres is bearing the weight of and supporting the bust, but also to give contour to the bust, they are typically provided with shoulder straps in the form of support tapes, which connect the bra cups with the rearward side panels. Naturally, aside from high wearing comfort, such brassieres are also expected to provide an appealing overall look.

Apart from the fact that typically, brassieres of this kind are comprised of a plurality of parts, which are interconnected by seams, they most often have support tapes, piping, or trimming tapes along their edges, which are most of the time attached with zigzag seams because particularly the side panels are frequently made of elastic materials. However, practical experience has shown that these seams often show through outer garments, which takes away from the overall look. Furthermore, these tapes fixed into place by seams come into direct contact with the skin of the person wearing the brassiere, which can cause skin irritations, particularly with people having sensitive skin, thus reducing the wearing comfort considerably. This is particularly true for the seams in the area of the side panels because a good fit of the brassiere requires proper tension of the side panels, whereby said panels are pressed to the upper body of the person wearing the brassiere.

The disadvantage of seams that externally, are visible through outer garments, and internally, tend to cause skin irritations, became especially apparent with brassieres, wherein the side panels are comprised of two or more layers of a textile material, which are hemmed along the free edges, and in view of the elasticity of the material used, most often have to be assembled with zigzag seams.

SUMMARY OF THE INVENTION

In view of this background, it is therefore an object of the invention to improve a conventional brassiere with respect to its wearing comfort and its overall look.

The invention is based on the idea to design the two-layered side panels of a brassiere such that the two layers are interconnected only in the peripheral areas at the upper and lower edge by internal plane bonding agents, in particular an adhesive layer. Due to the fact that both external surfaces of the side panels, that is, the visible outer side as well as the inner side facing the body, are comprised of textile material bare of any seams, the brassiere of the present invention not only attains a most appealing outer look, but on the inner side, direct contact between any seams and the skin is precluded. In this way, the wearing comfort is improved significantly, and even with sensitive skin, and the threat of skin irritations of any kind is eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
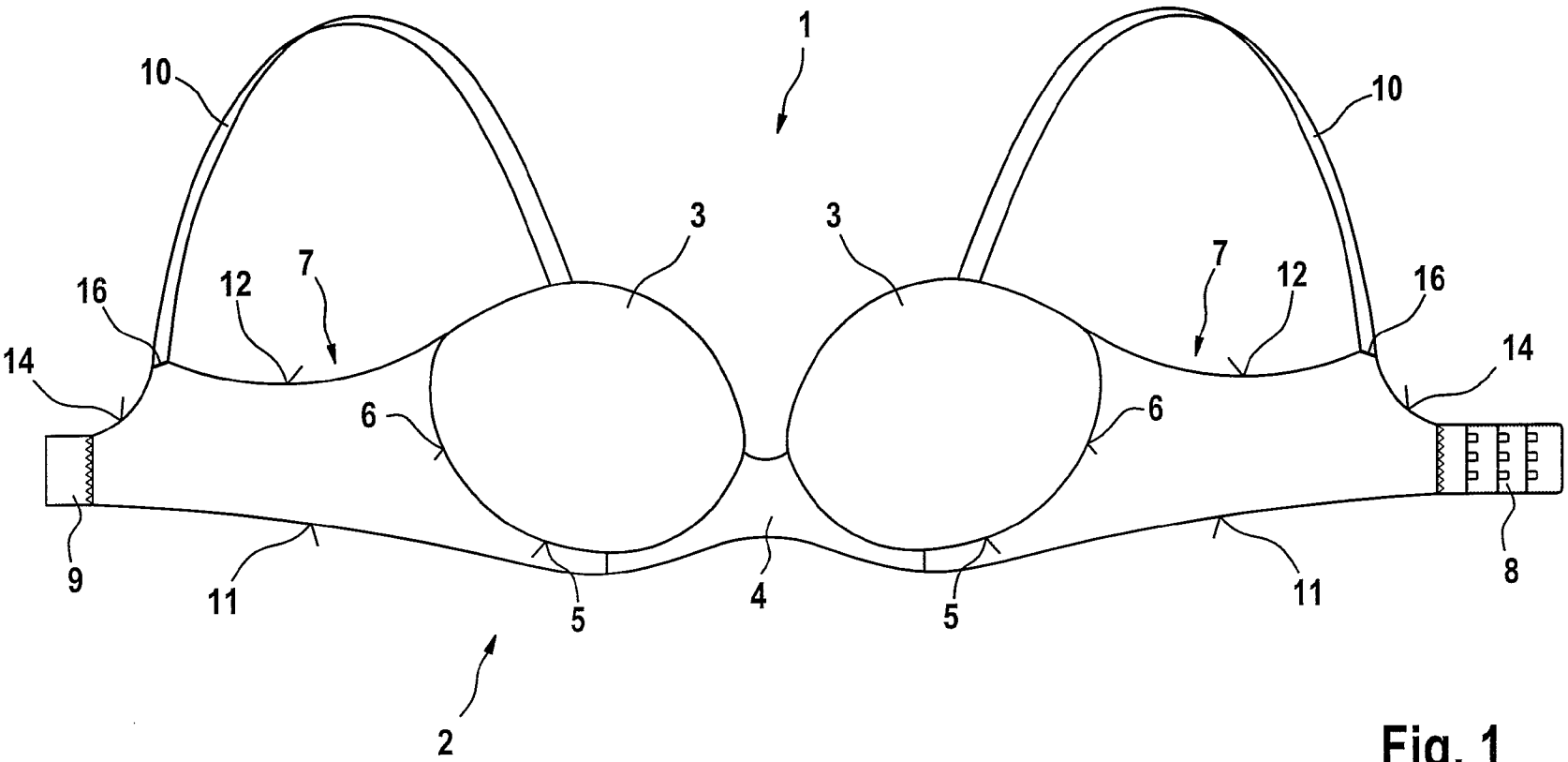
FIG. 1 is a front view of a brassiere according to the present invention.

In FIG. 1, a brassiere 1 of the present invention is illustrated in a front view. The brassiere 1 is comprised of a front section 2 having two bra cups 3 to accommodate the bust. The bra cups 3 can be of conventional design, that is, for example, have a rubber foam core, which is covered with a textile material, both on the outside and the inside. The two bra cups 3 are connected to one other by a center panel 4, which in the instant embodiment has a roughly trapezoidal shape.

Attached along the lower edge 5 and the lateral edge 6 of the bra cups 3 are the side panels 7, whereby at its free end, the left side panel 7 as seen in the illustration is provided with an eyelet 8, whereas the opposite side panel 7 is provided with a hook band 9. Together, eyelet 8 and hook band 9 provide, in well-known fashion, a back closure. Furthermore, the side panels 7 are defined by a lower edge 11, an upper edge 12, and a rearward edge 14.

Figure 3:
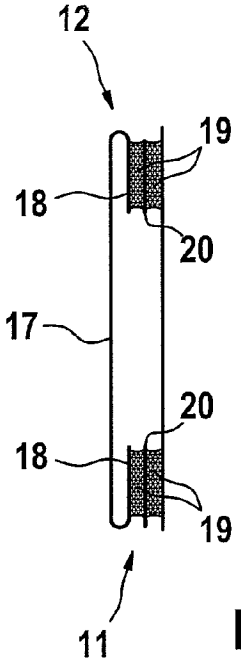
FIG. 3 is a section along the line III-III in FIG. 2.
Figure 2:
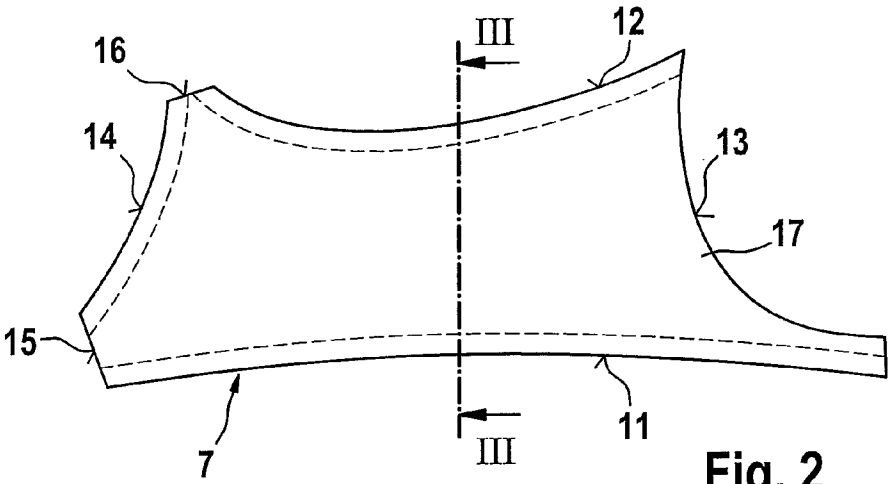
FIG. 2 is a schematic drawing of the external view of a side panel.
Figure 4:
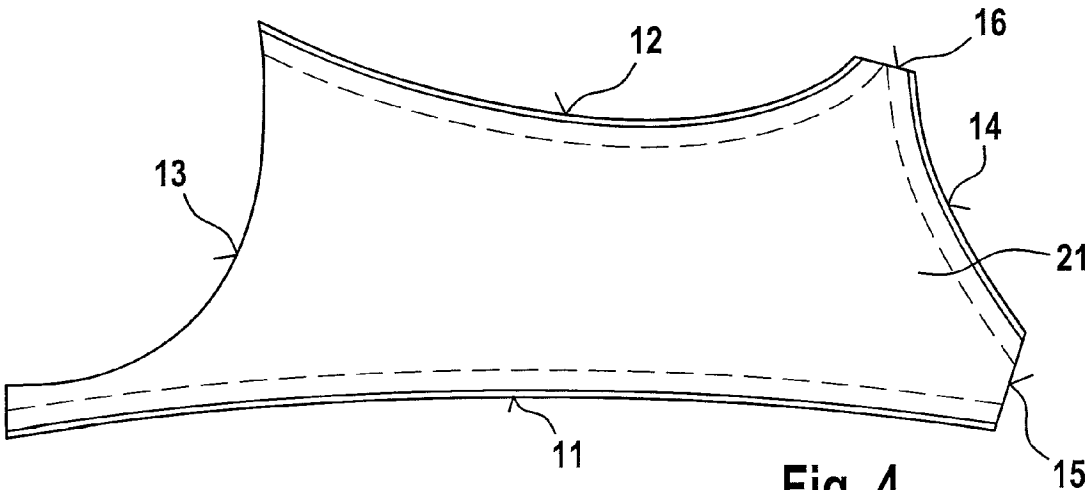
FIG. 4 is a schematic drawing of the internal view of the side panel according to FIG. 2.

The more detailed design of the side panels 7 is illustrated in the remaining figures, wherein FIGS. 2 and 4, respectively, illustrate the front view, that is, the interior view of a side panel 7, and FIG. 3 shows a section along the line III-III in FIG. 2.

In FIG. 2, the schematized shape of a side panel 7 can be seen, which, apart from the lower edge 11 and the upper edge 12, has a front edge 13 that is shaped to be attached to the lateral edge 6 of a bra cup 3, whereas the rearward edge 14 terminates in an attachment point 15 for the attachment of the eyelet 8 and/or the hook band 9. Between the upper edge 12 and the rearward free edge 14, an attachment point 16 for attaching a shoulder strap 10 is indicated.

From the cross section of side panel 7 according to FIG. 3 in particular can be seen that the outer layer 17 of the textile material forming the side panel 7 is turned over to the inside, both at the lower edge 11 and the upper edge 12. In the illustrated embodiment, an adhesive tape 20 is attached to these folded-over edges 18, which in turn is covered by the inner layer 21 of the textile material forming the side panel 7 towards the inside of the brassiere 1, thus bringing about a bonding 19 of the edges.

The adhesive tape 20 used to fix the folded-over edges 18 into place against the inner layer of material 21 is, for practical purposes, coated with a thermo-sensitive bonding agent. Thereafter, the adhesive tape 20 can simply be inserted between the pieces to be connected, and by applying pressure and/or heat, an intensive bonding of the pieces can be achieved. Naturally, instead of using an adhesive tape, it is also possible to coat the surfaces to be joined with a suitable bonding agent, which likewise can be activated by applying pressure and/or heat. Bonding agents, which fill these requirements, are known.

The invention is not limited to the embodiment illustrated in the drawings but also includes embodiments, which correspond with the object and purpose of the patent claims. For example, the term "brassiere" comprises all women's intimate apparel with built-in bust support, including bikini tops, swimsuits, and bodysuits, and the like.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A brassiere comprising:

a front section that includes two bra cups;

two side panels together from opposing directions encircling an upper body of a person wearing the brassiere, first ends of each of the two side panels ace laterally attached to said front section, and second ends of the two side panels being joined together at a back of the person whereby said side panels when joined encircle said upper body of said person, wherein the two side panels, respectively, are comprised of an outer layer and an inner layer of textile material, said side panels being joined to each other along upper and lower edges of said outer and inner layers only in the peripheral areas of said upper and lower edges, upper and lower edges of said outer layer being formed by folding inwardly an end portion of said outer layer between said outer layer and said inner layer to form a finished edge, and an adhesive layer joining said outer and inner layers between said folded portion and said inner layer.

2. The brassiere according to claim 1, wherein the adhesive layer is made of a thermo-sensitive material, which can be activated by applying pressure and/or heat.

3. The brassiere according to claim 1, wherein the adhesive layer is applied directly to the peripheral areas of the material blanks forming the side panels by a spraying, rolling, or pressure process.

4. The brassiere according to claim 1, wherein the adhesive layer is applied to an adhesive tape, which is inserted between the folded-over edge and the layer of textile material opposite thereof in order to interconnect the pieces.

5. The brassiere according to claim 4, wherein the adhesive tape has elastic properties.

6. The brassiere according to claim 1, wherein the adhesive layer is made of a polyurethane, a polyolephin, or a thermoplastic elastomer.

7. The brassiere according to claim 1, wherein the brassiere includes two shoulder straps, which extend from the bra cups toward a rearward area of the side panels.

* * * * *